US010730296B2

(12) United States Patent
Uchida et al.

(10) Patent No.: US 10,730,296 B2
(45) Date of Patent: Aug. 4, 2020

(54) LIQUID EJECTING HEAD AND LIQUID EJECTING APPARATUS

(71) Applicant: SEIKO EPSON CORPORATION, Tokyo (JP)

(72) Inventors: Kazuaki Uchida, Fujimi (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/365,355

(22) Filed: Mar. 26, 2019

(65) Prior Publication Data

US 2019/0299611 A1 Oct. 3, 2019

(30) Foreign Application Priority Data

Mar. 27, 2018 (JP) ..... 2018-059102
Nov. 13, 2018 (JP) ..... 2018-212958

(51) Int. Cl.
*B41J 2/14* (2006.01)

(52) U.S. Cl.
CPC ..... *B41J 2/14145* (2013.01); *B41J 2/14201* (2013.01); *B41J 2/14233* (2013.01)

(58) Field of Classification Search
CPC ..... B41J 2/14233; B41J 2/14274; B41J 2/14201; B41J 2/14145; B41J 2/1433; B41J 2/04525
See application file for complete search history.

(56) References Cited

U.S. PATENT DOCUMENTS

2016/0257126 A1 9/2016 Ishida
2016/0311221 A1* 10/2016 Menzel et al. ..... B41J 2/1433

FOREIGN PATENT DOCUMENTS

JP 2016-163965 A 9/2016

* cited by examiner

*Primary Examiner* — Juanita D Jackson
(74) *Attorney, Agent, or Firm* — Workman Nydegger

(57) ABSTRACT

A liquid ejecting head includes nozzles that eject a liquid, communication paths in which the respective nozzles are disposed and which are arrayed and partitioned from adjacent ones of communication paths by partition walls, pressure chambers which communicate with the respective communication paths and which are arrayed and partitioned from adjacent ones of pressure chambers by partition walls, pressure generating portions that are provided in the respective pressure chambers and that vary a pressure of the pressure chambers to cause the liquid to be ejected from the nozzles, and common flow paths through which at least one of supplying and discharging the liquid is performed to and from flow paths including the communication paths and the pressure chambers. A compliance of the partition walls of the communication paths is made larger than a compliance of the partition walls of the pressure chambers.

20 Claims, 5 Drawing Sheets

LIQUID EJECTING HEAD AND LIQUID EJECTING APPARATUS

The entire disclosure of Japanese Patent Application No. 2018-059102, filed Mar. 27, 2018 and 2018-212958, filed Nov. 13, 2018 are expressly incorporated by reference herein.

BACKGROUND

1. Technical Field

The present invention relates to a liquid ejecting head and a liquid ejecting apparatus.

2. Related Art

There is known a liquid ejecting head that is provided with a plurality of parallel liquid flow paths, nozzles, and pressure generating portions and that ejects a liquid such as ink from the nozzles, the nozzles and the pressure generating portions being provided on a flow path basis and each of the pressure generating portions generating pressure in a portion of the flow path (for example, JP-A-2016-163965).

In such a liquid ejecting head, when pressure is generated by the pressure generating portion, because pressure oscillation having a natural vibration period Tc is generated in the ink in the flow path, the ink ejection timing is based on this natural vibration period Tc. It is known that the natural vibration period Tc is affected by differences in the size of the flow path including a pressure chamber.

In a liquid ejecting head having a plurality of nozzles, ejection of ink is controlled for each nozzle. The inventors have discovered a new problem that, when pressure is generated in the pressure chambers corresponding to the plurality of nozzles, individual pressure chambers keep ink and therefore increased the inertance at the entrance from common flow paths to each of the flow paths including the pressure chambers, and the natural vibration period Tc of the ink fluctuates in accordance with the state of ejection. When the natural vibration period Tc fluctuates, a deviation corresponding to the fluctuation of the natural vibration period Tc occurs at the timing at which pressure is generated in the pressure chambers. As a result, there arises a problem that the ejection amount and the ejection speed of the ink fluctuate (hereinafter also referred to as "crosstalk").

SUMMARY

According to one aspect of the invention, there is provided a liquid ejecting head that ejects a liquid to the outside. The liquid ejecting head includes a plurality of nozzles that eject the liquid, a plurality of communication paths in which the respective nozzles are disposed and which are arrayed and partitioned from adjacent ones of the communication paths by partition walls, a plurality of pressure chambers that communicate with the respective communication paths and that are arrayed and partitioned from adjacent ones of the pressure chambers by partition walls, pressure generating portions that are provided in the respective pressure chambers and that increase a pressure of the pressure chambers to cause the liquid to be ejected from the nozzles, and common flow paths through which at least one of supplying and discharging the liquid is performed to and from flow paths including the plurality of communication paths and the plurality of pressure chambers. A compliance of the partition walls of the communication paths is made larger than a compliance of the partition walls of the pressure chambers.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
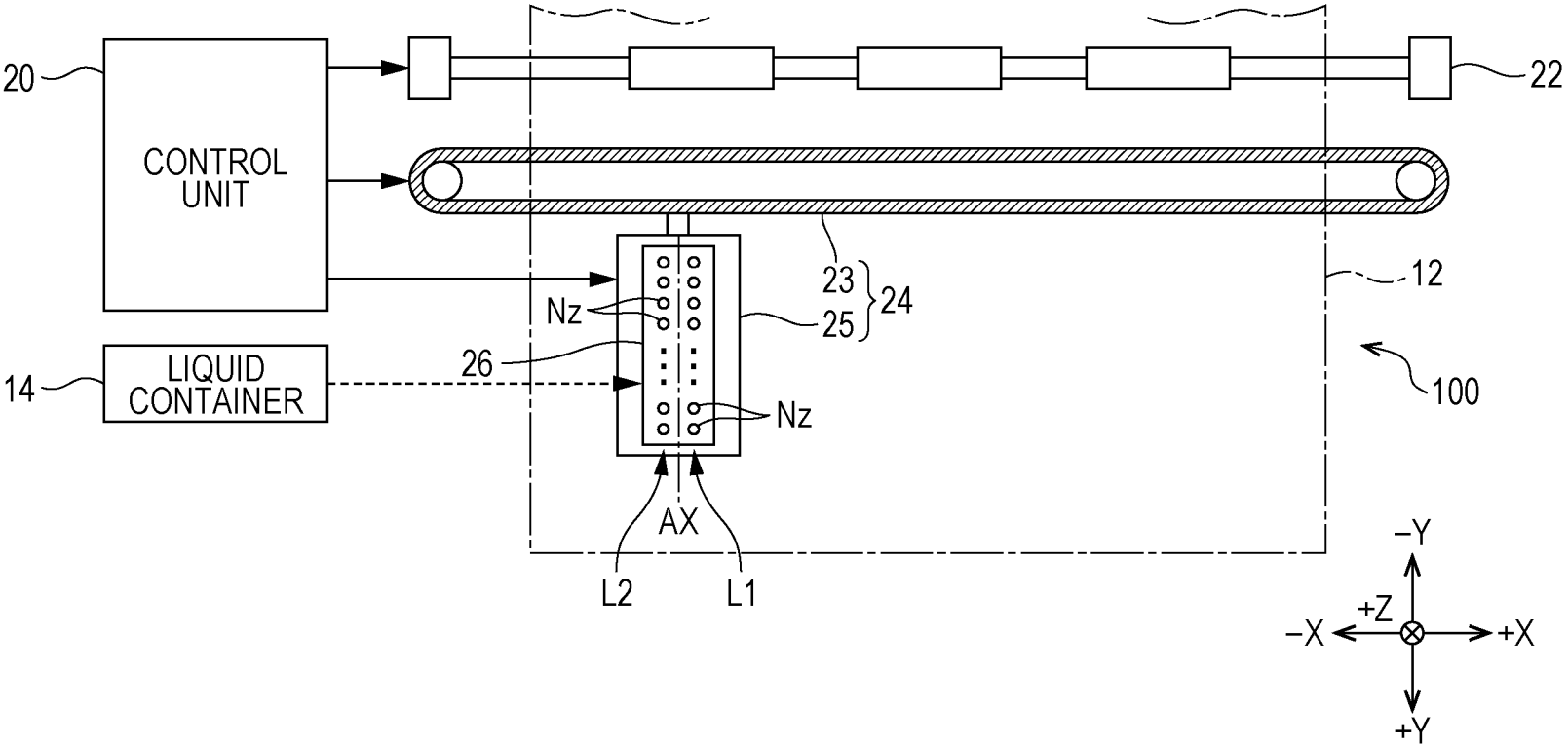
FIG. 1 is an explanatory view schematically illustrating a configuration of a liquid ejecting apparatus according to a first embodiment.

FIG. 1 is an explanatory view schematically illustrating a configuration of a liquid ejecting apparatus 100 according to an embodiment of the invention.

The liquid ejecting apparatus 100 is an ink jet printing apparatus that ejects ink, which is an example of a liquid, onto a medium 12. The liquid ejecting apparatus 100 uses, as well as printing paper, a print target of any material such as a resin film or cloth as the medium 12 and performs printing on such various types of medium 12. As illustrated in each of FIG. 1 and subsequent figures, the X direction is the transport direction (main scanning direction) of a liquid ejecting head 26 described later, the Y direction is the medium feeding direction (sub-scanning direction) perpendicular to the main scanning direction, and the Z direction is an ink ejection direction perpendicular to the XY plane. In addition, when specifying the direction, positive and negative signs are used together for describing directions, assuming that the positive direction is "+" and the negative direction is "–".

The liquid ejecting apparatus 100 includes a liquid container 14, a transport mechanism 22 that feeds out the medium 12, a control unit 20, a head moving mechanism 24, and the liquid ejecting head 26. The liquid container 14 individually stores a plurality of types of ink to be ejected from the liquid ejecting head 26. As the liquid container 14, a bag-like ink pack formed of a flexible film, an ink tank that enables replenishing of ink, or the like can be used. The control unit 20 includes a processing circuit such as a central processing unit (CPU) or a field programmable gate array (FPGA) and a memory circuit such as a semiconductor memory, and controls the transport mechanism 22, the head moving mechanism 24, the liquid ejecting head 26, and the like. The transport mechanism 22 operates under the control of the control unit 20 and feeds out the medium 12 in the +Y direction.

The head moving mechanism 24 includes a transport belt 23 wound over a printing area of the medium 12 in the X direction, and a carriage 25 that houses the liquid ejecting head 26 and fixes the liquid ejecting head 26 to the transport belt 23. The head moving mechanism 24 operates under the control of the control unit 20 and reciprocates the carriage 25 in the main scanning direction (X direction). When the carriage 25 reciprocates, the carriage 25 is guided by a guide rail (not illustrated). Further, note that a head configuration in which a plurality of liquid ejecting heads 26 are mounted on the carriage 25 or a head configuration in which the liquid container 14 is mounted on the carriage 25 together with the liquid ejecting head 26 may be used.

The liquid ejecting head 26 ejects the ink supplied from the liquid container 14 under the control of the control unit 20 from a plurality of nozzles Nz toward the medium 12. A desired image or the like is printed on the medium 12 by ejecting ink from the nozzles Nz during reciprocation of the liquid ejecting head 26. As illustrated in FIG. 1, the liquid ejecting head 26 includes nozzle lines in which a plurality of nozzles Nz are arranged in the sub-scanning direction, and these nozzle lines include two nozzle lines provided along the main scanning direction with a predetermined interval therebetween. The two nozzle lines are illustrated as a first nozzle line L1 and a second nozzle line L2 in the drawing, and the nozzles Nz of the first nozzle line L1 and the nozzles Nz of the second nozzle line L2 are provided in the main scanning direction.

In the following description, a YZ plane passing through in the Y direction including a center axis as the center of the first nozzle line L1 and the second nozzle line L2 is defined as a center plane AX for convenience of explanation. Further, note that the nozzles Nz of the first nozzle line L1 and the second nozzle line L2 may be disposed in a staggered pattern shifted in the medium feeding direction (Y direction). In addition, the first nozzle line L1 and the second nozzle line L2 are provided in accordance with a plurality of types of inks included in the liquid container 14, and illustration of other nozzle lines is omitted.

Figure 2:
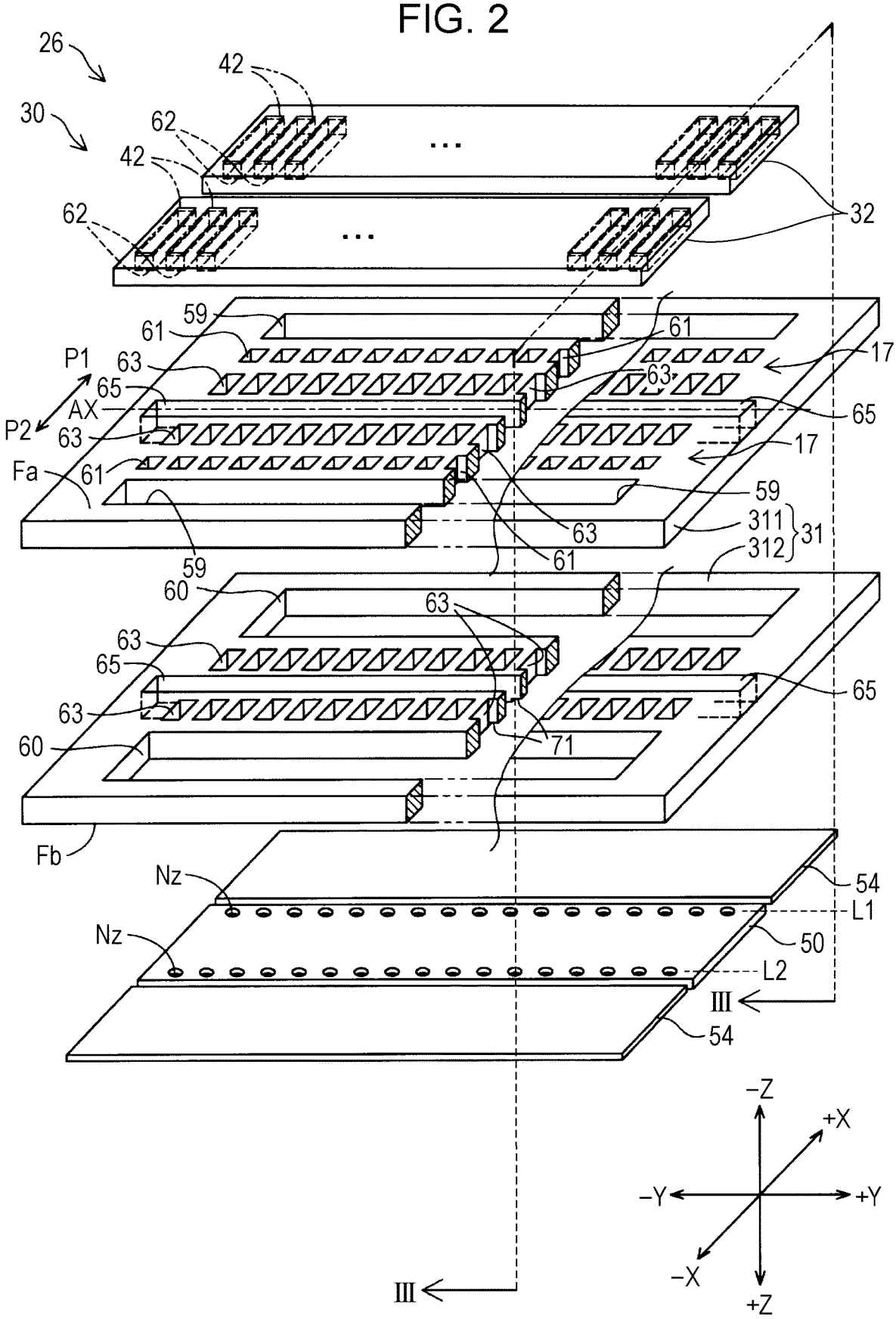
FIG. 2 is an explanatory diagram illustrating main head components of a liquid ejecting head in an exploded manner.
Figure 3:
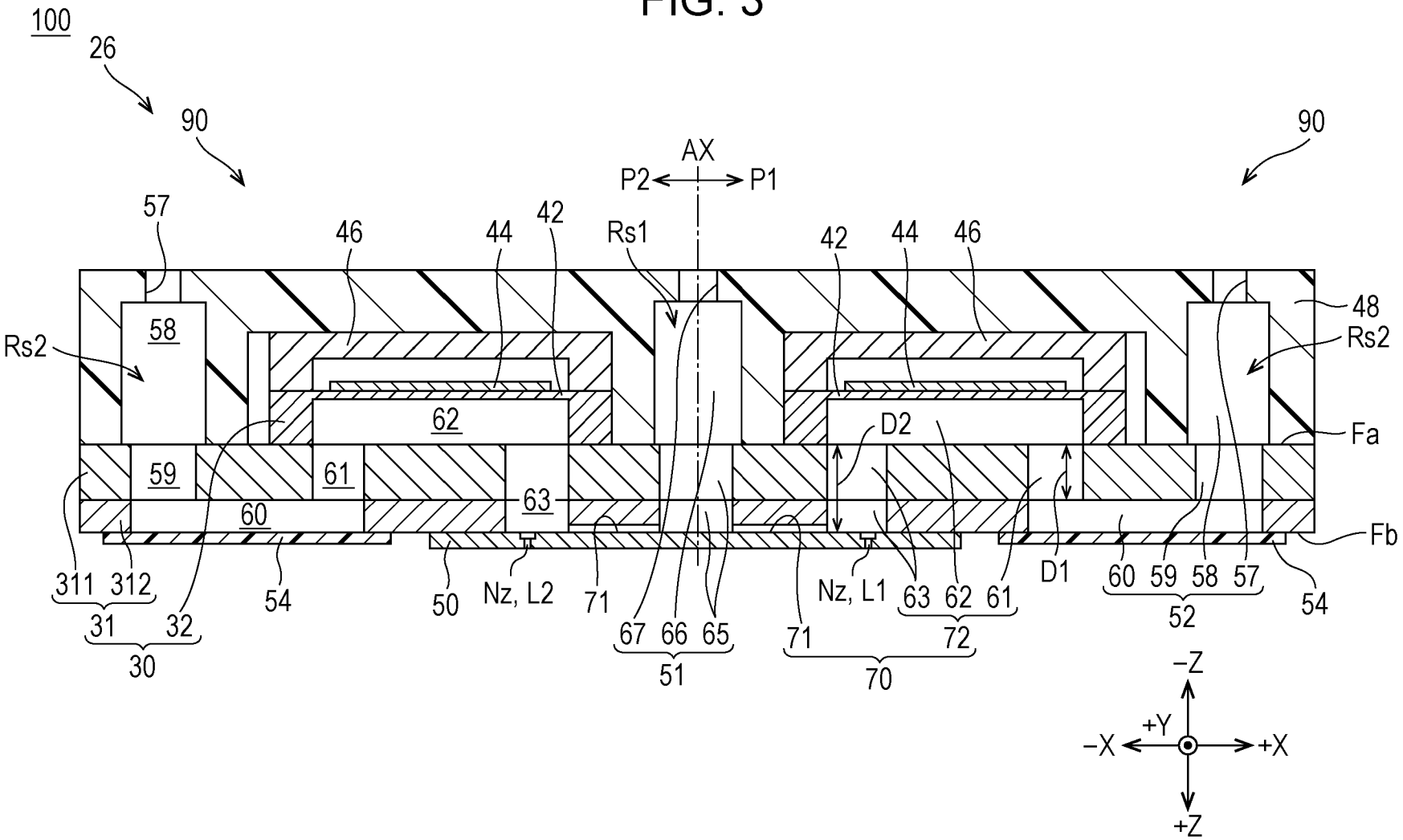
FIG. 3 is a sectional view of the liquid ejecting head at a position III-III in FIG. 2.
Figure 4:
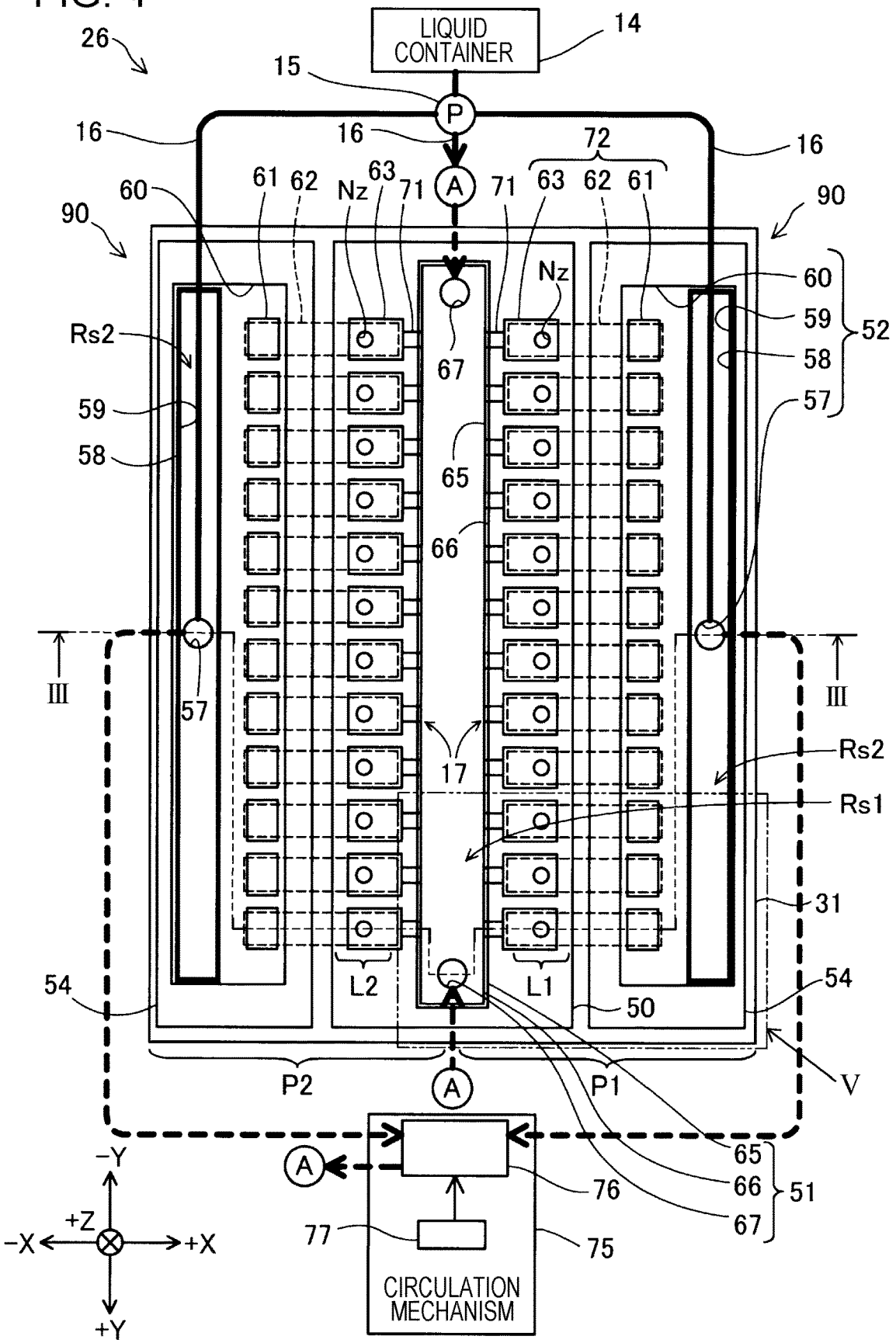
FIG. 4 is an explanatory view schematically illustrating a flow path of ink of the liquid ejecting head in plan view.

FIG. 2 is an explanatory diagram illustrating the main head components of the liquid ejecting head 26 in an exploded manner. The liquid ejecting head 26 having the first nozzle line L1 and the second nozzle line L2 is a multilayer body in which head components are stacked. In FIG. 2, to facilitate understanding, a portion of a first flow path substrate 31, which is a component, is broken off. In addition, FIG. 3 is a sectional view taken along the line III-III in FIG. 2. In addition, in order to facilitate understanding of the sectional view at position III-III in FIG. 3, the section line III-III is also indicated in FIG. 4 to be described later. Hereinafter, the structure of the liquid ejecting head 26 will be described with reference to both of the drawings as appropriate. Further, in FIG. 2 and FIG. 3, the thicknesses of the respective illustrated constituent members do not represent the actual thicknesses of the constituent members.

As illustrated in FIG. 2 and FIG. 3, in the liquid ejecting head 26, a housing portion 48, and second flow path substrates 32, a first communication plate 311, and a second communication plate 312, which form a flow path forming member 30, are stacked in this order from the −Z direction upper side. The first communication plate 311 and the second communication plate 312 form the first flow path substrate 31, which is a single plate body, with surfaces facing each other being connected by an adhesive. FIG. 2 illustrates a surface of the first communication plate 311 on the −Z direction side (hereinafter also referred to as "upper surface Fa of the first flow path substrate 31"), which is a portion of the first flow path substrate 31, and a surface of the second communication plate 312 on the +Z direction side (hereinafter also referred to as "lower surface Fb of the first flow path substrate 31"), which is a portion of the first flow path substrate 31.

A nozzle plate 50 and vibration absorbers 54 are attached to the lower surface Fb of the first flow path substrate 31 at positions not overlapping each other. The housing portion 48 is a member for covering the outer surfaces of the first flow path substrate 31 and protective members 46 described later and is formed by injection molding of a resin material. The housing portion 48 and the protective members 46 are not illustrated in FIG. 2 to facilitate understanding of the technology.

The liquid ejecting head 26 has a configuration related to the nozzles Nz of the first nozzle line L1, a configuration related to the nozzles Nz of the second nozzle line L2, and flow paths connected to the corresponding nozzles Nz so as to be plane symmetric with respect to the center plane AX. That is, in the liquid ejecting head 26, a first portion P1 on the +X direction side and a second portion P2 on the −X direction side with the center plane AX therebetween have the same configuration. The nozzles Nz of the first nozzle line L1 belong to the first portion P1, the nozzles Nz of the second nozzle line L2 belong to the second portion P2, and the center plane AX becomes the boundary plane between the first portion P1 and the second portion P2.

The flow path forming member 30 is formed by stacking two second flow path substrates 32 juxtaposed in the X direction on the upper surface Fa side of the first flow path substrate 31. The second flow path substrates 32 are plate bodies elongated in the Y direction.

As will be described below, liquid flow paths are formed by combining opening portions and grooves provided in the first communication plate 311 and the second communication plate 312, which form the first flow path substrate 31, and opening portions and grooves provided in the second flow path substrates 32. In addition, by attaching the nozzle plate 50 and the vibration absorbers 54 to the lower surface Fb of the first flow path substrate 31, the grooves provided on the lower surface Fb of the first flow path substrate 31 form flow paths between the nozzle plate 50 and the vibration absorbers 54.

Second inflow chambers 59, liquid supply chambers 60, individual supply paths 61, communication paths 63, first individual flow paths 71, and a first inflow chamber 65 are formed in the first flow path substrate 31 by connecting the first communication plate 311 and the second communication plate 312 to each other. The first inflow chamber 65 is an opening whose longitudinal direction is the Y direction and is provided so as to extend in the Y direction at the center of the first flow path substrate 31 in the X direction. On the other hand, the second inflow chambers 59 are openings whose longitudinal direction is the Y direction, and are provided so as to extend in the Y direction on both sides of the first flow path substrate 31 in the X direction. On the lower surface Fb of the first flow path substrate 31 at both sides of the first inflow chamber 65, grooves reaching respective ones of the communication paths 63 are formed as the first individual flow paths 71.

The first communication plate 311 is a silicon substrate and includes a portion of the communication paths 63 and the second inflow chambers 59, which are portions of second common flow paths 52. The second communication plate 312 is a glass substrate and includes a portion of the communication paths 63 and the liquid supply chambers 60, which are portions of the second common flow paths 52. The first communication plate 311 and the second communication plate 312 are stacked in this order from the −Z direction upper side and connect the portions of the communication paths 63 and the portions of the second common flow paths 52 to each other.

In addition, by connecting the first communication plate 311 and the second communication plate 312 to each other, on the lower surface Fb of the first flow path substrate 31, flow paths continuing from the second inflow chambers 59 to the center of the first flow path substrate 31 are formed as the liquid supply chambers 60. Hereinafter, when describing the configuration of each portion, the first communication plate 311 and the second communication plate 312 that are connected to each other are treated as the first flow path substrate 31. The second inflow chambers 59 and the liquid supply chambers 60 together with other constituent members provided in the housing portion 48 form the second common flow paths 52. The first inflow chamber 65 forms a first common flow path 51 together with other constituent members similarly provided in the housing portion 48. The configurations of the first common flow path 51 and the second common flow paths 52 will be described later in detail.

The number of the communication paths 63 and the individual supply paths 61 corresponding to the number of nozzles Nz are provided at positions interposed between the first inflow chamber 65 and the second inflow chambers 59. The communication paths 63 and the individual supply paths 61 are rectangular opening portions provided in the first flow path substrate 31. The communication paths 63 and the individual supply paths 61 together with pressure chambers 62 provided in the second flow path substrate 32 form second individual flow paths 72. Each of the individual supply paths 61 is formed only in the first communication plate 311 of the first flow path substrate 31, and the −Z direction side thereof is connected to a corresponding one of the pressure chambers 62 and the +Z direction side thereof is connected to a corresponding one of the liquid supply chambers 60 of the second communication plate 312. The detailed configuration and function of the second individual flow paths 72 will be described in detail later together with the first individual flow paths 71.

The two second flow path substrates 32 are fixed to the upper surface Fa of the first flow path substrate 31 on the −Z direction side by using an adhesive. The two second flow path substrates 32 are respectively installed in the first portion P1 and the second portion P2 of the upper surface Fa of the first flow path substrate 31. A plurality of rectangular grooves are formed on the lower surface side of the second flow path substrates 32. When the second flow path substrates 32 are respectively adhered to the first portion P1 and the second portion P2 of the first flow path substrate 31, the pressure chambers 62 are formed together with the upper surface Fa of the first flow path substrate 31. The outer shape on the +Z direction side of each of the pressure chambers 62 of the second flow path substrates 32 includes the outer shape on the −Z direction side of corresponding one of the individual supply paths 61 and corresponding one of the communication paths 63 of the first flow path substrate 31. Accordingly, the pressure chambers 62, the individual supply paths 61, and the communication paths 63 are connected to each other to form the second individual flow paths 72.

FIG. 3 illustrates the relationship between a length D1 of the individual supply paths 61 in a direction along the ink flow direction in the individual supply paths 61 and a length D2 of the communication paths 63 in the direction along the ink flow direction in the communication paths 63. In the present specification, the direction along the ink flow direction in the flow path means the macroscopic ink flow direction at the central portion of the flow path. In the present embodiment, the length D1 of the individual supply paths 61 is smaller than the length D2 of the communication paths 63.

Piezoelectric elements 44 are attached to portions of the upper surfaces (the surfaces on the −Z direction side) of the second flow path substrates 32 corresponding to the pressure chambers 62 and form vibration portions 42. The depth of the grooves constituting the pressure chambers 62 is set to be slightly smaller than the thickness of the second flow path substrates 32. That is, the portions of the second flow path substrates 32 corresponding to the pressure chambers 62 are made thin and are wall surfaces that can deform in accordance with the distortion of the piezoelectric elements 44.

The nozzle plate 50 attached to the lower surface Fb of the first flow path substrate 31 is a planar member having a plurality of nozzles Nz. The nozzle plate 50 is formed of a silicon (Si) single-crystal substrate and the nozzles Nz are formed by a semiconductor manufacturing technique, for example, a processing technique such as dry etching or wet etching.

The nozzles Nz are through holes for ejecting the ink to the outside. In the present embodiment, the ink ejection direction of the nozzles Nz is the +Z direction. The plurality of nozzles Nz are arranged in respective straight lines as the first nozzle line L1 and the second nozzle line L2.

The wall surface on the −Z direction side of the nozzle plate 50 is attached to the lower surface Fb of the first flow path substrate 31 so that each of the nozzles Nz is located just below (+Z direction side of) a corresponding one of the communication paths 63. At this time, the wall surface on the −Z direction side of the nozzle plate 50 other than the nozzles Nz covers the first individual flow paths 71 formed between the first inflow chamber 65 and the communication paths 63 of the first flow path substrate 31. Therefore, the nozzle plate 50 becomes an inner wall of the flow paths at the portions of the first inflow chamber 65, the first individual flow paths 71, and the communication paths 63 of the first flow path substrate 31.

As illustrated in the drawing, the two vibration absorbers 54 arranged on both sides of the nozzle plate 50 in the X direction have a film having flexibility. The vibration absorbers 54 are formed of, for example, a compliance substrate. The respective surfaces of the vibration absorbers 54 on the −Z direction side are attached to the first portion P1 and the second portion P2 of the lower surface Fb of the first flow path substrate 31 by using an adhesive. At this time, the vibration absorbers 54 are disposed so as to cover the liquid supply chambers 60 and the second inflow chambers 59 of the first flow path substrate 31. As a result, the surfaces of the vibration absorbers 54 on the −Z direction side become the inner walls of respective flow paths in the portions of the liquid supply chambers 60 and the second inflow chambers 59.

As illustrated in FIG. 3, the housing portion 48 is fixed to the upper surface Fa of the first flow path substrate 31 on the −Z direction side with an adhesive. Second liquid chambers 58, which are grooves having the same shape as that of the second inflow chambers 59, are provided in the housing portion 48 at positions corresponding to the second inflow chambers 59 provided in the first flow path substrate 31. The second inflow chambers 59 are provided with second circulation ports 57 at the center thereof in the Y direction. The second liquid chambers 58 and the second circulation ports 57 form the second common flow paths 52 together with the liquid supply chambers 60 and the second inflow chambers 59 described above. In this manner, each of the second liquid chambers 58 is connected to a corresponding one of the second inflow chambers 59 to form one space and functions as an ink storage chamber (reservoir Rs2). With this configuration, the second common flow paths 52 are formed as common flow paths through which at least one of supplying and discharging ink is performed to and from the plurality of communication paths 63 and the pressure chambers 62 in common. In addition, as described above, by stacking the first communication plate 311 and the second communication plate 312, the first flow path substrate 31 of the liquid ejecting head 26 of the present embodiment connects the portions of the second common flow paths 52 to each other. This makes it possible to further increase the volume of the second common flow paths 52 connected to the second individual flow paths 72 and it becomes easier to supply the ink to the second individual flow paths 72.

A first liquid chamber 66, which is a groove having the same shape as that of the first inflow chamber 65, is provided at the center of the housing portion 48 in the X direction at a position corresponding to the first inflow chamber 65 and first circulation ports 67, which are through holes, are provided at both ends of the first liquid chamber 66 in the Y direction. The first liquid chamber 66 and the first circulation ports 67 together with the first inflow chamber 65 (already described) form the first common flow path 51. The first liquid chamber 66 and the first inflow chamber 65 form an ink storage chamber (reservoir Rs1). With this configuration, a common flow path is formed through which at least one of supplying and discharging ink is performed to and from the plurality of the communication paths 63 and the pressure chambers 62 in common.

Furthermore, the housing portion 48 has groove portions, which have the same shape as that of the second flow path substrates 32, formed therein at positions corresponding to the second flow path substrates 32, and, within these groove portions, houses the second flow path substrates 32 and the protective members 46 that protect the piezoelectric elements 44 attached to the upper surface of the second flow path substrates 32.

The structure of the liquid ejecting head 26 described above is summarized as follows. At the center of the liquid ejecting head 26 in the X direction, the first common flow path 51 is formed along the Y direction. On the other hand, on both sides of the liquid ejecting head 26 in the X direction, the second common flow paths 52 are formed along the Y direction. Considering the communication paths 63 where the nozzles Nz exist as centers, the first individual flow paths 71 exist between the communication paths 63 and the first common flow path 51, and the second individual flow paths 72 exist between the communication paths 63 and the second common flow paths 52. Therefore, if the liquid is filled from the first common flow path 51 to the second common flow paths 52, when liquid flows from the first circulation ports 67 of the first common flow path 51, the liquid flows from the first common flow path 51, which is a common flow path, passes through the plurality of first individual flow paths 71 and reaches the communication paths 63, furthermore, from here, it passes through the plurality of second individual flow paths 72 and gathers again in the second common flow paths 52, which are common flow paths. When the liquid flows from the second circulation ports 57 of the second common flow paths 52, the flow of the liquid is reversed. As described above, the liquid ejecting head 26 of the present embodiment has a symmetrical structure on both sides across the center plane AX illustrated in FIG. 1. It is preferable to perform circulation at least at the time of ejecting liquid from the nozzles Nz as a countermeasure to crosstalk, more preferably during non-ejection in terms of prevention of drying of the nozzles and removal of air bubbles and foreign matter from the flow paths. The flow paths from the first common flow path 51 to the second common flow paths 52 are collectively referred to as circulation flow paths 90.

In the liquid ejecting head 26 of the present embodiment, for one first common flow path 51, a plurality of individual flow paths 70 and one second common flow path 52 are provided on the first portion P1 side and a plurality of individual flow paths 70 and one second common flow path 52 are provided on the second portion P2 side. Further, the plurality of individual flow paths 70 in one circulation flow path 90 is also referred to as an "individual flow path group 17". The liquid ejecting head 26 includes the individual flow path groups 17 in each of the first portion P1 and the second portion P2. That is, in the liquid ejecting head 26 of the present embodiment, one first common flow path 51 and two second common flow paths 52 are connected by two individual flow path groups 17 to form two circulation flow paths 90. As described above, in the liquid ejecting head 26 of the present embodiment, the number of the nozzles Nz provided in one liquid ejecting head 26 is increased by providing a plurality of the circulation flow paths 90.

The piezoelectric elements 44 are so-called piezo elements and are active elements that deform upon receipt of a drive signal from the control unit 20. The piezoelectric elements 44 generate vibration by this deformation. Vibration caused by the piezoelectric elements 44 is transmitted to the vibration portions 42, causing a change in pressure in the ink inside the pressure chambers 62. In this way, the vibration portions 42 including the piezoelectric elements 44 function as pressure generating portions that change the pressure of the liquid in the pressure chambers 62 for corresponding ones of the nozzles Nz of the first nozzle line L1 and the second nozzle line L2. This pressure change reaches the nozzles Nz via the communication paths 63 and causes the ink to be ejected from the nozzles Nz.

In the liquid ejecting head 26 of the present embodiment, when ink flows through the inside of the flow paths, the flow path resistance in the first individual flow paths 71 on the upstream side of the communication paths 63 is set to be larger than each of the flow path resistances of the pressure chambers 62 and the individual supply paths 61 on the downstream side of the communication paths 63. Therefore, the occurrence of crosstalk accompanying supply of ink to the first individual flow paths 71 at the time of liquid ejection can be suppressed.

When the flow path resistance of the first individual flow paths 71 on the upstream side of the communication paths 63 is set to be larger than the flow path resistance of each of the pressure chambers 62 and the individual supply paths 61 on the downstream side of the communication paths 63, like the liquid ejecting head 26 of the present embodiment, the vibration absorbers 54 are preferably provided at positions corresponding to the inner walls of the second common flow paths 52 on the downstream side of the flow paths. In particular, within the second common flow paths 52, it is most preferable to provide the vibration absorbers 54 on the liquid supply chambers 60, which are closest to the individual supply paths 61. At the time of liquid ejection, due to the pressure generated in the pressure chambers 62, ink in addition to the ink in the first individual flow paths 71 is supplied to the communication paths 63 from the second common flow paths 52 on the side where the flow path resistance is small. Therefore, by providing the vibration absorbers 54 in the second common flow paths 52, it is possible to increase the inertance of the second common flow paths 52 and to suppress the occurrence of crosstalk.

FIG. 4 is an explanatory diagram schematically illustrating a path of ink in plan view from the upper surface side of the liquid ejecting head 26. In FIG. 4, in order to facilitate understanding of the technology, members that cannot be visually recognized due to members positioned on the near side of the drawing are also illustrated.

As described above, the liquid ejecting head 26 of the present embodiment includes, on both sides of the center plane AX, two circulation flow paths 90 formed of the first common flow path 51, the second common flow paths 52, the first individual flow paths 71, and the second individual flow paths 72. The liquid ejecting head 26 further includes the liquid container 14, a pump 15, supply tubes 16, and a circulation mechanism 75.

The liquid container 14 is a tank that stores ink. The liquid container 14 is connected to the pump 15. The supply tubes 16 are tubes for supplying the ink supplied from the liquid container 14 to the circulation flow paths 90. In the present embodiment, four supply tubes 16 are provided, and are connected to two first circulation ports 67 and two second circulation ports 57.

The ink stored in the liquid container 14 is pumped inside the supply tubes 16 by the pump 15. The pressurized ink is selectively supplied to the second circulation ports 57 or the first circulation ports 67 in accordance with the ink flow direction in the circulation flow paths 90. In the present embodiment, the ink stored in the liquid container 14 is supplied to the first circulation ports 67.

The circulation mechanism 75 is a flow mechanism that moves the ink supplied to the second circulation ports 57 or the first circulation ports 67 through the circulation flow paths 90. In the present embodiment, the circulation mechanism 75 is connected to the side opposite to the side having the nozzles Nz of the liquid ejecting head 26 (that is, the upper surface side). The circulation mechanism 75 includes an ink storage tank 76 and a pressure adjustment unit 77. The pressure adjustment unit 77 adjusts the pressure of the ink inside the ink storage tank 76 to be lower than the pressure feed pressure of the pump 15. The circulation of the ink in the circulation flow paths 90 is realized by adjusting the pressure by the pump 15 and the pressure adjustment unit 77.

The arrows illustrated in FIG. 4 schematically show the flow direction of the ink in this embodiment. The ink stored in the liquid container 14 and the ink stored in the ink storage tank 76 are pressure-fed to the first circulation ports 67 of the first common flow path 51. The ink supplied from the first circulation ports 67 passes through the first liquid chamber 66 and reaches the first inflow chamber 65. The ink reaching the first inflow chamber 65 contacts the inner wall of the nozzle plate 50 and flows along the surface direction of the nozzle plate 50. At this time, the ink spreads along the Y direction and is distributed to the first individual flow paths 71 of each of the individual flow path groups 17 of the first portion P1 and the second portion P2.

The ink flowing into the first individual flow paths 71 flows along the surface direction of the nozzle plate 50 and is supplied to the communication paths 63 of the second individual flow paths 72. The ink flowing into the communication paths 63 is guided to the pressure chambers 62 connected to the communication paths 63. At this time, when vibration by the piezoelectric elements 44 is transmitted to the ink, the ink in the communication paths 63 is ejected from the nozzles Nz to the outside.

The ink flowing into the pressure chambers 62 is guided to the individual supply paths 61. The inks discharged from the individual supply paths 61 of the individual flow path groups 17 join in the liquid supply chambers 60 of the second common flow paths 52. The ink in the liquid supply chambers 60 is led to the second inflow chambers 59 along the wall surface of the vibration absorbers 54. The ink that has flowed into the second inflow chambers 59 flows into the second liquid chambers 58 and is discharged from the second circulation ports 57 to the ink storage tank 76 (described later).

As described above, in the liquid ejecting head 26 according to the present embodiment, the ink supplied to the first common flow path 51 passes through the first individual flow paths 71 and the second individual flow paths 72 and flows through the second common flow paths 52. That is, the first common flow path 51 is the upstream side of the ink flow path in this embodiment and the second common flow paths 52 are the downstream side of the ink flow path. The ink that has passed through the second common flow paths 52 is sent to the circulation mechanism 75 and is again supplied to the first common flow path 51. As described above, in the liquid ejecting head 26 of the present embodiment, the ink is circulated by the two circulation flow paths 90 and the circulation mechanism 75. Further, the internal pressure of the downstream side flow paths becomes lower than the internal pressure of the upstream side flow paths due to the attenuation of the pressure applied to the pressurized ink.

Figure 5:
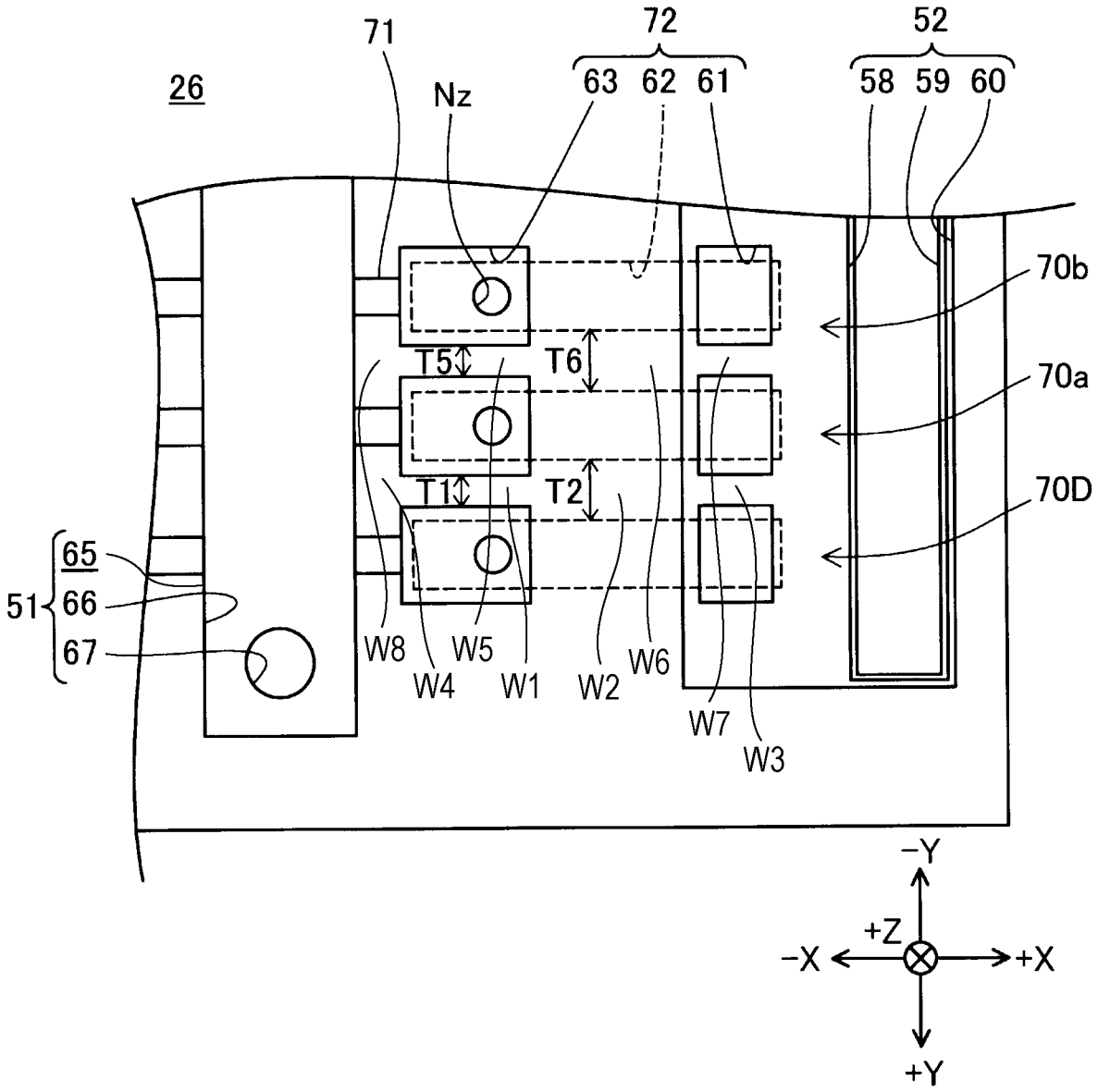
FIG. 5 is an enlarged plan view of an area V in FIG. 4.

FIG. 5 is an enlarged plan view of the area V in FIG. 4. FIG. 5 illustrates, within the circulation flow path 90, three individual flow paths 70 on the end portion side in the +Y direction in addition to the first common flow path 51 and the second common flow path 52. Hereinafter, each of the three individual flow paths 70 includes an individual flow path 70D located at the end portion on the +Y direction side, an individual flow path 70*a* adjacent to the individual flow path 70D, and an individual flow path 70*b* adjacent to the individual flow path 70*a*.

The individual flow path 70D is a so-called dummy flow path. In the present embodiment, the flow path configuration of the individual flow path 70D is the same as the flow path configuration of the other individual flow paths 70, and the ink is circulated also in the individual flow path 70D. However, the piezoelectric element 44 of the individual flow path 70D is not driven, and the ink is not ejected from the nozzle Nz of the individual flow path 70. Further, it is not necessary to provide the nozzle Nz of the individual flow path 70D. Likewise, the piezoelectric element 44 need not be provided. In such an aspect, any configuration may be used as long as the ink is not ejected by the individual flow path 70D.

In the liquid ejecting head 26 according to the present embodiment, the individual flow path 70D positioned closest to the end portion has the individual flow path 70*a* on the −Y direction side; however, a wall surface is provided on the +Y direction side by using a member. That is, the compliance of the wall surface on the +Y direction side is substantially zero. Therefore, in each of the circulation flow paths 90, the individual flow path 70D to be a dummy flow path is provided at both ends in the Y direction. As a result, the compliance of the partition wall of the individual flow path 70D, which is a dummy flow path, can also be obtained for the individual flow path 70*a* adjacent to the dummy flow path.

Hereinafter, the compliance configuration of the liquid ejecting head 26 of the present embodiment will be described with reference to FIG. 5 and FIG. 3. In the liquid ejecting head 26 of the present embodiment, the communication path 63 of the individual flow path 70*a* is arrayed and partitioned from the communication path 63 of the individual flow path 70*b* adjacent on the −Y direction side by a partition wall W5, and is arrayed and partitioned from the communication path 63 of the individual flow path 70D adjacent on the +Y direction side by a partition wall W1. The thickness of the partition wall W1 is a thickness T1. The pressure chamber 62 of the individual flow path 70*a* is arrayed and partitioned from the pressure chamber 62 of the individual flow path 70*b* by a partition wall W6 and is arrayed and partitioned from the pressure chamber 62 of the individual flow path 70D by a partition wall W2. Likewise, the individual supply path 61 and the first individual flow path 71 of the individual flow path 70*a* are arrayed and partitioned from the individual supply path 61 and the first individual flow path 71 of the individual flow path 70*b* by a partition wall W7 and a partition wall W8, respectively, and arrayed and partitioned from the individual supply path 61 and the first individual flow path 71 of the individual flow path 70D by a partition wall W3 and a partition wall W4, respectively. In FIG. 5, thicknesses T1, T2, T5, and T6 of the partition walls W1, W2, W5, and W6, respectively, are illustrated.

In the liquid ejecting head 26 of the present embodiment, the sum of compliances C1 and C5 of the partition walls W1 and W5 adjacent to the communication paths 63 is greater than the sum of compliances C2 and C6 of the partition walls W2 and W6 on both sides of the pressure chamber 62, compliances C4 and C8 of the partition walls W4 and W8 on both sides of the first individual flow path 71, and compliances C3 and C7 of the partition walls W3 and W7 of the individual supply paths 61. That is, it is expressed by the following expression (1).

$$(C1+C5)>(C2+C3+C4+C6+C7+C8) \quad (1)$$

In the individual flow path 70*a*, pressure vibration of the natural vibration period Tc is generated in the ink due to the variation of the volume of the pressure chamber by the pressure generating portion of the individual flow path 70*a*. More specifically, when a pressure fluctuation is caused in the ink in the pressure chamber 62 by the pressure generating portion and ink is ejected from the nozzle Nz, as the pressure fluctuates, pressure vibration behaving as if the inside of the pressure chamber 62 is an acoustic tube (natural vibration of the ink) is excited in the ink in the pressure chamber 62. This natural vibration period Tc can be expressed by the following expression (2).

$$Tc=2\pi\sqrt{(M\times C)} \quad (2)$$

M: Inertance of the individual flow path 70*a*

C: Compliance of the individual flow path 70*a*

For example, when a plurality of pressure generating portions of the individual flow paths 70 are simultaneously driven, the ink in the first inflow chamber 65 is supplied to the plurality of the first individual flow paths 71. In doing so, adjacent ones of the first individual flow paths 71 behave so as to compete with each other for ink. Therefore, the partition walls between the respective flow paths are pseudo-extended and the inertance of the first individual flow paths 71 may be increased in some cases. Therefore, the inertance M2 in the case where the pressure generating portions of the plurality of individual flow paths 70 are simultaneously driven can be expressed by the following expression (3).

$$M2=M1+\Delta M \quad (3)$$

M1: Inertance of the flow path when the pressure generating portion of one individual flow path 70 is driven ΔM: Estimated value of inertance increased by pseudo extension of partition walls between the first individual flow paths 71 adjacent to the one individual flow path 70 Therefore, the natural vibration period Tc2 increases inertance by ΔM with respect to the natural vibration period Tc1, and the period value increases.

When the natural vibration period Tc in the case where the pressure generating portion of one individual flow path 70 is driven is taken as the natural vibration period Tc1, it can be expressed by the following expression (4).

$$Tc1=2\pi\sqrt{/(M1\times C1)} \quad (4)$$

M1: Total inertance of the individual flow path 70 through which ink flows C1: Total compliance in the case where the pressure generating portion of one individual flow path 70 is driven At this time, the compliance C1 can be expressed by the following equation (5).

$$C1=Ci1+Cd1+Cw1 \quad (5)$$

Ci1: Compliance of ink in the individual flow path 70 when the pressure generating portion of one individual flow path 70 is driven Cd1: Compliance of the vibration plate of the vibration portion 42 when the pressure generating portion of one individual flow path 70 is driven Cw1: Compliance of partition walls of the individual flow path 70 in the case where the pressure generating portion of one individual flow path 70 is driven When the natural vibration period Tc in the case where the pressure generating portions of the plurality of individual flow paths 70 are simultaneously driven is taken as the natural vibration period Tc2, it can be expressed by the following expression (6).

$$Tc2=2\pi\sqrt{(M2\times C2)} \quad (6)$$

C2: Total compliance when multiple pressure generating portions are simultaneously driven As described above, the natural vibration period Tc2 is larger than the natural vibration period Tc1.

In addition, when the pressure generating portions of the plurality of individual flow paths 70 are simultaneously driven, substantially the same pressure is generated in each of the pressure chambers 62. Therefore, the partition walls between the pressure chambers 62 are not deformed when substantially the same pressures oppose each other (balanced), and the compliance Cw2 of the partition walls of the individual flow paths 70 is substantially zero. Therefore, the compliance C2 can be expressed by the following equation (7).

$$C2=Ci2+Cd2 \quad (7)$$

Ci2: Compliance of ink in the individual flow paths 70 when the pressure generating portions of the plurality of the individual flow paths 70 are driven Cd2: Compliance of the vibration plates of the vibration portions 42 when the pressure generating portions of the plurality of the individual flow paths 70 are driven Here, the compliance Ci of the ink in the individual flow paths 70 is defined by the physical property value of the ink and the volume of the flow path. Therefore, the magnitude of ink compliance Ci does not change between the case of driving the pressure generating portion of one individual flow path 70 and the case of driving the pressure generating portions of a plurality of individual flow paths 70. Therefore, Ci1=Ci2 can be considered. Similarly, the direction of deformation of the vibration plate is a direction perpendicular to the direction in which the plurality of the individual flow paths 70 are arrayed. Therefore, the compliance Cd of the vibration plates of the vibration portions 42 is not influenced mutually by the plurality of the individual flow paths 70. As a result, Cd1=Cd2 can be considered.

Therefore, in the case where the pressure generating portion of one individual flow path 70 is driven, the compliance C1 is larger than the compliance C2 in the case of driving the pressure generating portions of the plurality of the individual flow paths 70 by the compliance Cw1 of the partition walls of the individual flow paths 70. To summarize the above, the relationship in the breakdown of the natural oscillation periods Tc1 and Tc2 represented by the above equations (4) and (6) is M1<M2, C1>C2, and C1 is larger than C2 by Cw1. Therefore, by increasing the compliance Cw1 of the partition walls of the individual flow paths 70, the difference between the natural vibration period Tc1 and the natural vibration period Tc2 can be reduced.

In the liquid ejecting head 26 of the present embodiment, the sum of the compliances C1 and C5 of the partition walls W1 and W5 adjacent to the communication paths 63 is greater than the sum of the compliances C2 and C6 of the partition walls W2 and W6 on both sides of the pressure chamber 62, the compliances C4 and C8 of the partition walls W4 and W8 on both sides of the first individual flow paths 71, and the compliances C3 and C7 of the partition walls W3 and W7 of the individual supply paths 61. Therefore, the compliance Cw1 of the partition walls of the flow paths can be increased. Therefore, it is possible to reduce the difference between the natural vibration periods Tc1 and Tc2. As a result, among the plurality of individual flow paths 70 that are adjacent to each other, the change in natural oscillation period Tc between the case of driving one pressure generating portion and the case of driving a plurality of pressure generating portions becomes small and the occurrence of crosstalk can be suppressed.

In addition, in the liquid ejecting head 26 of this embodiment, the thickness T5 of the partition wall W5 of the communication path 63 is smaller than the thickness T6 of the partition wall W6 of the pressure chamber 62, and the thickness T1 of the partition wall W1 of the communication path 63 is smaller than the thickness T2 of the partition wall W2 of the pressure chamber 62. Here, the compliance Cw can be expressed by the following expression (8).

$$Cw=(1-p^2)\times W^5\times L/(60\times E\times T^3) \quad (8)$$

p: Poisson's ratio of partition wall
W: Length in the transverse direction of the partition wall
L: Length in the longitudinal direction of the partition wall
E: Young's modulus of partition wall
T: Thickness of partition wall In the liquid ejecting head 26 of the present embodiment, the thickness of the partition wall W2 of the communication path 63 is smaller than the thickness of the partition wall W6 of the pressure chamber 62, and the thickness of the partition wall W1 of the communication path 63 is smaller than the thickness of the partition wall W2 of the pressure chamber 62. Therefore, it is possible to increase the compliance of the communication path 63, which is the flow path in the vicinity of the nozzle Nz.

As illustrated in FIG. 3, in the liquid ejecting head 26 of the present embodiment, the first communication plate 311 and the second communication plate 312, which are two communication plates, are connected to each other and portions forming the communication paths 63 are connected to each other, thereby increasing the area of the partition walls of the communication paths 63 and increasing the compliance of the partition walls of the communication paths 63. Further, note that the number of the communication plates is not limited to two, and may be three or more. As a result, it is possible to increase the compliance of the partition walls of the communication paths in accordance with the stacking amount of the communication plates.

As illustrated in FIG. 3, in the liquid ejecting head 26 of the present embodiment, the length D1 of the individual supply paths 61 is smaller than the length D2 of the communication paths 63. Therefore, the inertance of the individual supply paths 61 is reduced, the natural vibration period Tc can be shortened, and the ejection cycle of the liquid from the nozzles Nz can be shortened.

The individual supply paths 61 are formed only in the first communication plate 311 of the first flow path substrate 31 and, by stacking the second communication plate 312 on the first communication plate 311, the flow path lengths of the communication paths 63 and the liquid supply chambers 60 are extended with respect to the flow path length of the individual supply paths 61. As a result, while maintaining the flow path length of the individual supply paths 61, the compliance of the partition walls of the communication paths 63 is increased and the volume of the liquid supply chambers 60 is increased. Therefore, by enlarging the reservoir Rs2 while maintaining the inertance of the individual supply paths 61, it is possible to more easily supply ink to the second individual flow paths 72.

The first flow path substrate 31 is formed of a plurality of communication plates, and the second communication plate 312 is formed of a glass substrate. Borosilicate glass is used for the glass substrate of this embodiment. As a result, the partition walls of the flow paths of the first flow path substrate 31 have a lower Young's modulus than a silicon substrate. As a result, as illustrated in the above formula (8), it is possible to provide the flow paths with partition walls having greater compliance.

Further, it is preferable to use a material having a linear expansion coefficient similar to that of silicon (Si) (the linear expansion coefficient of silicon is about $42\times10^{-7}$/° C.) for the glass substrate. In addition, as for borosilicate glass, the linear expansion coefficient of Pyrex (registered trademark) of Corning Incorporated (USA) and Tempacs Float (registered trademark) of Shot company (Germany) is $32\times10^{-7}$/° C. Since the linear expansion coefficient is close to that of silicon, either borosilicate glass is preferably used as the glass substrate.

The first communication plate 311 of the first flow path substrate 31 is formed of a silicon substrate. Compared with borosilicate glass, silicon is easier to process finely. Therefore, for example, with respect to the individual supply paths 61, it is possible to form fine flow paths by application of semiconductor technology. Further, it is preferable to use silicon for the nozzle plate 50 having fine flow paths such as the nozzles Nz.

As described above, the compliance of the partition walls of the flow paths is increased in the liquid ejecting head 26 of the present embodiment. Therefore, for example, it is also possible to adopt an aspect in which the vibration absorbers 54 are not provided. As a result, the liquid ejecting head 26 can be reduced in size.

B. Other Embodiments (B1) In the liquid ejecting head 26 of the above embodiment, the sum of the compliances C1 and C5 of the partition walls W1 and W5 adjacent to the communication path 63 is larger than the sum of the compliances C2 and C6 of the partition walls W2 and W6 of the pressure chamber 62, the compliances C4 and C8 of the partition walls W4 and W8 on both sides of the first individual flow path 71, and the compliances C3 and C7 of the partition walls W3 and W7 of the individual supply path 61. On the other hand, the compliance of the partition walls of the communication path may be larger than the compliance of the partition walls of the pressure chamber. The compliance C1 of a partition wall of the communication path may be larger than the compliance C2 of a partition wall of one adjacent pressure chamber and the compliances (C1+C5) of the partition walls on both sides of the communication path may be larger than the compliances (C2+C6) of the partition walls on both sides of the adjacent pressure chamber. Even in such an aspect, it is possible to increase the compliance of the partition walls of the communication path, which is the flow path in the vicinity of the nozzle.

(B2) In the liquid ejecting head 26 of the above embodiment, the thickness T5 of the partition wall W5 of the communication path 63 is smaller than the thickness T6 of the partition wall W6 of the pressure chamber 62, and the thickness T1 of the partition wall W1 of the communication path 63 is smaller than the thickness T2 of the partition wall W2 of the pressure chamber 62. On the other hand, the thickness of the partition walls of the communication path may be greater than the thickness of the partition walls of the pressure chamber. In such an aspect, for example, it is preferable to increase the compliance of the partition walls of the communication path by further increasing the flow path length of the communication path.

Even in such an aspect, it is possible to increase the compliance of the partition walls of the communication path, which is the flow path in the vicinity of the nozzle.

(B3) In the liquid ejecting head 26 of the above-described embodiment, the individual flow path 70D, which is a dummy flow path, is provided at the end portion sides of the individual flow paths 70 that are arrayed. On the other hand, an aspect in which the dummy flow path is not provided may be adopted. Even in such an aspect, by increasing the compliance of the partition walls of the communication paths, it is possible to reduce a change in the natural vibration period Tc with the case of driving the plurality of pressure generating portions.

(B4) In the liquid ejecting head 26 of the above embodiment, the length D1 of the individual supply paths 61 is smaller than the length D2 of the communication paths 63. On the other hand, the length D1 of the individual supply paths may be larger than the length D2 of the communication paths. Even in such an aspect, by increasing the compliance of the partition walls of the communication paths, it is possible to reduce a change in the natural vibration period Tc with the case of driving the plurality of pressure generating portions.

(B5) In the liquid ejecting head 26 of the above embodiment, the first flow path substrate 31 includes the first communication plate 311 and the second communication plate 312. On the other hand, the first flow path substrate may be formed of one communication plate. In such an aspect, it is preferable to perform processing so that the length of the communication path is larger than the length of the individual supply path inside one communication plate. Even with such an aspect, the same effect as the above embodiment can be obtained.

(B6) In the liquid ejecting head 26 of the above embodiment, the individual supply paths 61 are formed only in the first communication plate 311 of the first flow path substrate 31. On the other hand, the individual supply paths may be formed over a plurality of communication plates. In such an aspect, it is preferable that the flow path length of the communication paths be longer than the flow path length of the individual supply paths.

(B7) In the liquid ejecting head 26 of the above embodiment, the second communication plate 312 is formed of a glass substrate. On the other hand, the second communication plate may be formed of a ceramic substrate or any of various substrates other than a silicon substrate such as a single crystal substrate. Even in such an aspect, by increasing the compliance of the partition walls of the communication paths, it is possible to reduce a change in the natural vibration period Tc with the case of driving the plurality of pressure generating portions.

(B8) In the liquid ejecting head 26 of the above embodiment, the first communication plate 311 of the first flow path substrate 31 is formed of a silicon substrate. On the other hand, the first communication plate may be composed of a glass substrate or a ceramic substrate or any of various substrates other than a silicon substrate such as a single crystal substrate. Even in such an aspect, by increasing the compliance of the partition walls of the communication paths, it is possible to reduce a change in the natural vibration period Tc with the case of driving the plurality of pressure generating portions.

(B9) In the above embodiment, in the liquid ejecting head 26, the first common flow path 51 and the two second common flow paths 52 are connected by two individual flow path groups 17 to form two circulation flow paths 90. On the other hand, the number of the second common flow paths may be one, or the number of the second common flow paths may be three or more. In such an aspect, it is more preferable to provide the same number of individual flow path groups as the second common flow paths.

(B10) In the liquid ejecting head 26 of the above embodiment, in the case where ink flows in the inside of the flow paths, the flow path resistance of the flow paths on the upstream side of the communication paths 63 is set larger than the flow path resistance of the flow paths on the downstream side of the communication paths 63. On the other hand, the flow path resistance of the flow paths on the upstream side of the communication paths 63 may be set to be smaller than the flow path resistance of the flow paths on the downstream side of the communication paths 63. Even in such an aspect, by increasing the compliance of the partition walls of the communication paths, it is possible to reduce a change in the natural vibration period Tc with the case of driving the plurality of pressure generating portions. In the case where the flow path resistance of the flow paths on the upstream side of the communication paths 63 is set to be smaller than the flow path resistance of the flow paths on the downstream side of the communication paths 63, it is preferable to provide the vibration absorber 54 in the common flow path on the upstream side. In this case, ink is supplied from the second circulation ports 57 in FIG. 3.

(B11) In the liquid ejecting head 26 of the above embodiment, ink is ejected using a piezoelectric element. On the other hand, it is possible to use any of various types of element other than the piezo element as the ejection driving element. For example, the invention can be applied to a printer having a discharge driving element of a type that energizes a heater disposed in an ink path and discharges ink by using bubbles generated in the ink path.

(B12) In the liquid ejecting head 26 of the above embodiment, the circulation mechanism 75 is connected to the upper surface side of the liquid ejecting head 26. In contrast, the liquid ejecting head need not include a circulation mechanism, and the liquid ejecting apparatus may include a circulation mechanism. In such an embodiment, it is preferable to connect the flow paths such that the circulation mechanism performs at least one of supply and discharge of ink through the first common flow path and the second common flow paths.

C. Other Aspects

The invention is not limited to the above-described embodiment, and can be realized in various aspects without departing from the gist thereof. For example, the invention can be realized by the following aspects.

Technical features in the above embodiments corresponding to the technical features in each of the embodiments described below may be used for solving some or all of the problems of the invention or achieving some or all of the effects of the invention, and may be replaced or combined as appropriate in order to achieve the object. In addition, unless technical features are described as essential in this specification, they can be deleted as appropriate.

(1) According to one aspect of the invention, there is provided a liquid ejecting head that ejects a liquid to the outside. The liquid ejecting head includes a plurality of nozzles that eject the liquid, a plurality of communication paths in which the respective nozzles are disposed and that are arrayed and partitioned from adjacent ones of the communication paths by partition walls, a plurality of pressure chambers that communicate with the respective communication paths and that are arrayed and partitioned from adjacent ones of the pressure chambers by partition walls, pressure generating portions that are provided in the respective pressure chambers and that vary a pressure of the pressure chambers to cause the liquid to be ejected from the nozzles, and common flow paths through which at least one of supplying and discharging the liquid is performed to and from flow paths including the plurality of communication paths and the plurality of pressure chambers. A compliance of the partition walls of the communication paths is made larger than a compliance of the partition walls of the pressure chambers. According to this liquid ejecting head, the compliance of the partition walls of the communication paths is larger than the compliance of the partition walls of the pressure chambers. Therefore, it is possible to increase the compliance of the partition walls of the communication paths, which are the flow paths in the vicinity of the nozzles. Therefore, it is possible to reduce the difference between the natural vibration periods Tc1 and Tc2. As a result, among the plurality of adjacent individual flow paths, the change in the natural vibration period Tc between the case of driving one pressure generating portion and the case of driving a plurality of pressure generating portions becomes small and the occurrence of crosstalk can be suppressed.

(2) In the liquid ejecting head according to the above aspect, the common flow paths may include a first common flow path through which the liquid is supplied to the pressure chambers and a second common flow path in which the liquid that has passed through the communication paths and the pressure chambers is received. The communication paths and the pressure chambers form a portion of a plurality of individual flow paths connecting the first common flow path and the second common flow path. The plurality of individual flow paths include a plurality of first individual flow paths which connect the communication paths and the first common flow path, and which are arrayed and partitioned from adjacent ones of the first individual flow paths by partition walls, and a plurality of individual supply paths which are flow paths connecting the pressure chambers and the second common flow path, and which are arrayed and partitioned from adjacent ones of the individual supply paths by partition walls. The compliance of the partition walls of the communication paths is made larger than a sum of the compliance of the partition walls of the pressure chambers, a compliance of the partition walls of the first individual flow paths, and a compliance of the partition walls of the individual supply paths. According to this liquid ejecting head, the compliance of the partition walls between the adjacent communication paths is larger than the sum of the compliance of the partition walls between the pressure chambers, the compliance of the partition walls between the first individual flow paths, and the compliance of the partition walls between the second individual flow paths. Therefore, the compliance of the partition walls of the communication paths, which are the flow paths in the vicinity of the nozzles, becomes larger. Therefore, among the plurality of adjacent individual flow paths, the change in the natural vibration period Tc between the case of driving one pressure generating portion and the case of driving a plurality of pressure generating portions becomes small and it is possible to suppress the occurrence of crosstalk.

(3) In the liquid ejecting head of the above aspect, dummy flow paths that do not allow the liquid to be ejected to the outside may be adjacent to ones of the plurality of individual flow paths provided on both ends of an array of the plurality of individual flow paths. According to this liquid ejecting head, individual flow paths serving as dummy flow paths are provided at both ends of the plurality of individual flow paths. As a result, the compliance due to the partition wall of the individual flow paths that are the dummy flow paths can also be obtained for the individual flow paths adjacent to the dummy flow paths.

(4) In the liquid ejecting head of the above aspect, a length of the individual supply paths in a direction along a flow direction of the liquid in the individual supply paths may be made smaller than a length of the communication paths in the direction along the flow direction of the liquid in the communication paths. According to this liquid ejecting head, it is possible to shorten the flow path length of the individual supply paths with respect to the communication paths. Therefore, the inertance of the individual supply paths is reduced, the natural vibration period Tc can be shortened, and the ejection cycle of the liquid from the nozzles can be shortened (5) The liquid ejecting head of the above-described aspect may include a plurality of plate-like communication plates each including a portion of the communication paths and a portion of the second common flow path, and a flow path substrate that is formed by stacking the plurality of communication plates and that connects the portions of the communication paths and the portions of the second common flow path to each other. According to this liquid ejecting head, it is possible to increase the area of the partition walls of the communication paths. Therefore, the compliance of the communication paths can be increased in accordance with the stacking amount of the communication plates. In addition, the volume of the second common flow paths connected to the second individual flow paths can be increased, and the supply of ink to the second individual flow paths is further facilitated.

(6) In the liquid ejecting head of the above aspect, the individual supply paths may be included in one of the communication plates, which is connected to the pressure chambers, of the flow path substrate. According to this liquid ejecting head, the volume of the communication paths and the second common flow paths can be increased while maintaining the flow path length of the individual supply paths. Therefore, while maintaining the inertance of the individual supply paths, the compliance of the communication paths can be increased, and ink can be more easily supplied to the second individual flow paths.

(7) In the liquid ejecting head of the above aspect, the communication plate including the individual supply paths may be a silicon substrate. According to this liquid ejecting head, the communication plate having the second individual flow paths is formed of a silicon substrate, and the partition walls of the flow paths are formed of the communication plate including the glass substrate. With respect to the second individual flow paths, it is possible to form fine flow paths by application of semiconductor technology and to provide the flow paths with partition walls having greater compliance.

(8) In the liquid ejecting head of the above aspect, at least one of the plurality of the communication plates may be a glass substrate. According to this liquid ejecting head, the partition walls of the flow paths are formed of the glass substrate. Therefore, it is possible to form partition walls of flow paths having a low Young's modulus compared with an aspect in which partition walls of flow paths are formed only with a silicon substrate. As a result, as illustrated in the above formula (7), it is possible to provide the flow paths with partition walls having a greater compliance.

(9) In the liquid ejecting head of the above aspect, a thickness of the partition walls of the communication paths may be made smaller than a thickness of the partition walls of the pressure chambers. According to this liquid ejecting head, the thickness T of the partition walls of the communication paths is smaller than the thickness of the partition walls of the pressure chambers. Therefore, it is possible to increase the compliance of the communication paths, which are the flow paths in the vicinity of the nozzles.

(10) In the liquid ejecting head of the above-described aspect, when the liquid flows through an inside of the flow paths, a flow path resistance of flow paths on a side having an internal pressure higher than an internal pressure of communication paths may be set to be larger than a flow path resistance of flow paths on a side having an internal pressure lower than the internal pressure of the communication paths. According to this liquid ejecting head, when the liquid flows through the inside of the flow paths, the flow paths are provided such that the flow path resistance of the flow paths on the upstream side of the communication path is larger than that of the flow paths on the downstream side. Therefore, the occurrence of crosstalk with supply of ink to the flow paths can be suppressed.

(11) In the liquid ejecting head of the above-described aspect, planar vibration absorbers that absorb a change in pressure in the common flow paths may be provided. The flow paths on the side having the low internal pressure include a portion of the common flow paths and the vibration absorbers form inner walls of the common flow paths on the side having the low internal pressure. According to the liquid ejecting head of this aspect, the vibration absorbers are provided at positions so as to be the inner wall of the common flow paths, which are on the downstream side of the flow paths having a small flow path resistance. As a result, the inertance of the common flow paths can be increased and the occurrence of crosstalk can be suppressed.

(12) The liquid ejecting head of the above aspect may further include a flow mechanism that moves the liquid through the flow paths. According to this liquid ejecting head, a flow mechanism is provided in the liquid ejecting head of the liquid ejecting apparatus. Therefore, it is possible to realize a liquid ejecting head having a flow mechanism without enlarging the apparatus.

(13) According to another aspect of the invention, a liquid ejecting apparatus is provided. The liquid ejecting apparatus includes the liquid ejecting head of the above-described aspect and a flow mechanism for moving the liquid through the flow paths via the common flow paths. According to this liquid ejecting apparatus, the liquid ejecting apparatus is provided with a flow mechanism that causes the liquid to flow through the flow paths in the liquid ejecting head. Therefore, it is possible to cause the liquid to flow through the flow paths of the liquid ejecting head by the flow mechanism having a larger output.

The invention is not limited to the liquid ejecting apparatus that ejects ink, but can also be applied to any liquid ejecting apparatus that ejects liquid other than ink. For example, the invention is applicable to various liquid ejecting apparatuses as follows. The invention can be realized in the form of an image recording apparatus such as a facsimile apparatus, a color material ejecting apparatus used for manufacturing a color filter for an image display apparatus such as a liquid crystal display, an electrode material ejecting apparatus used in the manufacture of electrode structures such as those of an organic electro luminescence (EL) display, a field emission display (FED), and the like, a liquid ejecting apparatus for ejecting a liquid containing bioorganic matter used in the manufacture of biochips, a sample ejection device as a precision pipette, a lubricating oil ejector, a resin liquid ejector, a liquid ejecting apparatus that ejects lubricating oil in a pinpoint manner to a precision machine such as a watch or a camera, a liquid ejecting apparatus that ejects a transparent resin liquid such as an ultraviolet curable resin liquid or the like onto a substrate to form a micro hemispherical lens (optical lens) or the like used for an optical communication element or the like, a liquid ejecting apparatus that ejects an acidic or alkaline etching liquid for etching a substrate, a liquid ejecting apparatus including a liquid ejecting head that ejects an arbitrarily small amount of liquid droplets, or the like.

What is claimed is:

1. A liquid ejecting head that ejects a liquid to an outside, comprising:

a plurality of nozzles that eject the liquid;

a plurality of communication paths in which the respective nozzles are disposed, the communication paths being arrayed and partitioned from adjacent ones of the communication paths by partition walls;

a plurality of pressure chambers that communicate with the respective communication paths, the pressure chambers being arrayed and partitioned from adjacent ones of the pressure chambers by partition walls;

pressure generating portions that are provided in the respective pressure chambers and that vary a pressure of the pressure chambers to cause the liquid to be ejected from the nozzles; and common flow paths through which at least one of supplying and discharging the liquid is performed to and from a plurality of flow paths including the plurality of communication paths and the plurality of pressure chambers, wherein a compliance of the partition walls of the communication paths is made larger than a compliance of the partition walls of the pressure chambers.

2. The liquid ejecting head according to claim 1, wherein the common flow paths include a first common flow path through which the liquid is supplied to the pressure chambers, and a second common flow path in which the liquid that has passed through the communication paths and the pressure chambers is received, wherein the communication paths and the pressure chambers form a portion of a plurality of individual flow paths connecting the first common flow path and the second common flow path, wherein the plurality of individual flow paths include a plurality of first individual flow paths connecting the communication paths and the first common flow path, the first individual flow paths being arrayed and partitioned from adjacent ones of the first individual flow paths by partition walls, and a plurality of individual supply paths that are flow paths connecting the pressure chambers and the second common flow path, the individual supply paths being arrayed and partitioned from adjacent ones of the individual supply paths by partition walls, and wherein the compliance of the partition walls of the communication paths is made larger than a sum of the compliance of the partition walls of the pressure chambers, a compliance of the partition walls of the first individual flow paths, and a compliance of the partition walls of the individual supply paths.

3. The liquid ejecting head according to claim 2, wherein dummy flow paths that do not allow the liquid to be ejected to the outside are adjacent to ones of the plurality of individual flow paths provided on both ends of an array of the plurality of individual flow paths.

4. A liquid ejecting apparatus on which the liquid ejecting head according to claim 3 is mounted, comprising a flow mechanism for moving the liquid through the flow paths via the common flow paths.

5. The liquid ejecting head according to claim 2,

Wherein a length of the individual supply paths in a direction along a flow direction of the liquid in the individual supply paths is made smaller than a length of the communication paths in the direction along the flow direction of the liquid in the communication paths.

6. The liquid ejecting head according to claim 5, further comprising:

a plurality of plate-like communication plates each including a portion of the communication paths and a portion of the second common flow path; and a flow path substrate that is formed by stacking the plurality of communication plates and that connects the portions of the communication paths and the portions of the second common flow path to each other.

7. The liquid ejecting head according to claim 6, wherein the individual supply paths are included in one of the communication plates, which is connected to the pressure chambers, of the flow path substrate.

8. The liquid ejecting head according to claim 7, wherein the communication plate including the individual supply paths is a silicon substrate.

9. A liquid ejecting apparatus on which the liquid ejecting head according to claim 8 is mounted, comprising a flow mechanism for moving the liquid through the flow paths via the common flow paths.

10. A liquid ejecting apparatus on which the liquid ejecting head according to claim 7 is mounted, comprising a flow mechanism for moving the liquid through the flow paths via the common flow paths.

11. The liquid ejecting head according to claim 6, wherein at least one of the plurality of communication plates is a glass substrate.

12. A liquid ejecting apparatus on which the liquid ejecting head according to claim 11 is mounted, comprising a flow mechanism for moving the liquid through the flow paths via the common flow paths.

13. A liquid ejecting apparatus on which the liquid ejecting head according to claim 6 is mounted, comprising a flow mechanism for moving the liquid through the flow paths via the common flow paths.

14. A liquid ejecting apparatus on which the liquid ejecting head according to claim 5 is mounted, comprising a flow mechanism for moving the liquid through the flow paths via the common flow paths.

15. A liquid ejecting apparatus on which the liquid ejecting head according to claim 2 is mounted, comprising a flow mechanism for moving the liquid through the flow paths via the common flow paths.

16. The liquid ejecting head according to claim 1, wherein a thickness of the partition walls of the communication paths is made smaller than a thickness of the partition walls of the pressure chambers.

17. The liquid ejecting head according to claim 1, wherein, when the liquid flows through an inside of the flow paths, a flow path resistance of flow paths on a side having an internal pressure higher than an internal pressure of the communication paths is set to be larger than a flow path resistance of flow paths on a side having an internal pressure lower than the internal pressure of the communication paths.

18. The liquid ejecting head according to claim 17, further comprising planar vibration absorbers that absorb a change in pressure in the common flow paths, wherein the flow paths on the side having the low internal pressure include a portion of the common flow paths, and wherein the vibration absorbers form inner walls of the common flow paths on the side having the low internal pressure.

19. The liquid ejecting head according to claim 1 further comprising a flow mechanism that moves the liquid through the flow paths.

20. A liquid ejecting apparatus on which the liquid ejecting head according to claim 1 is mounted, comprising a flow mechanism for moving the liquid through the flow paths via the common flow paths.

* * * * *